US005416552A

United States Patent [19]

Fakler

[11] Patent Number: 5,416,552

[45] Date of Patent: May 16, 1995

[54] APPARATUS AND METHOD FOR REPLENISHING DEVELOPER

[75] Inventor: John T. Fakler, Phoenix, Ariz.

[73] Assignee: Surface Tek, Inc., Scottsdale, Ariz.

[21] Appl. No.: 187,916

[22] Filed: Jan. 28, 1994

[51] Int. Cl.[6] ..... G03D 5/00; G03D 3/02

[52] U.S. Cl. ..... 354/317; 354/324

[58] Field of Search ..... 354/316, 317, 322–324; 204/235–241, 130, 153.15, 400; 134/103, 105, 198, 199, 122 P, 122 R, 64 P, 64 R; 156/345, 901, 902, 626, 627, 642, 656, 666

[56] References Cited

U.S. PATENT DOCUMENTS

| | | | |
|---|---|---|---|
| 3,630,865 | 12/1971 | Minklei et al. | 204/143 |
| 4,042,444 | 8/1977 | Snyder | 156/345 |
| 4,190,481 | 2/1980 | Goffredo | 156/345 |
| 4,501,480 | 2/1985 | Matsui et al. | 354/317 X |
| 4,577,950 | 3/1986 | Mackson | 354/324 |
| 4,710,261 | 12/1987 | Dennis | 156/626 |
| 4,755,844 | 7/1988 | Tsuchiya et al. | 354/317 |
| 4,826,605 | 5/1989 | Doble et al. | 210/721 |
| 4,886,590 | 12/1989 | Tittle | 204/232 |
| 5,019,229 | 5/1991 | Grapentin et al. | 204/130 |
| 5,032,204 | 7/1991 | Haas | 156/345 |
| 5,223,881 | 6/1993 | Nakagawa et al. | 254/298 |
| 5,237,360 | 8/1993 | Patton | 354/324 |

*Primary Examiner*—D. Rutledge
*Attorney, Agent, or Firm*—Cahill, Sutton & Thomas

[57] ABSTRACT

A replenishing solution is mixed from liquid concentrate and tap water. Rather than measure the flow of liquids, apparatus measures static volumes of reagents, then transfers the reagents to a replenishing tank where they are mixed and brought to a predetermined temperature. Precise volumes are measured by weirs in each of the containers for water and concentrate. The replenishing solution is added to a developer in amounts determined by the pH of the developer. The electrode of a meter used for measuring pH are protected from scale or deposits by a sequestering agent, preferably EDTA, in the replenishing solution.

14 Claims, 1 Drawing Sheet

APPARATUS AND METHOD FOR REPLENISHING DEVELOPER

BACKGROUND OF THE INVENTION

This invention relates to a system for etching or developing photoresist and, in particular, to an apparatus and method for replenishing developer in such a way as to maintain the composition of the developer as constant as possible.

A printed circuit board consists of an insulating substrate, such as phenolic or fiberglass, and at least one adherent, conductive layer. The conductive layer completely covers a major surface of the substrate and, at this stage, does not define a circuit. A circuit is defined by coating the conductive layer with photoresist, patterning the photoresist, and transferring the pattern to the conductive layer.

Photoresist is a material which chemically changes in response to actinic radiation, typically incident light. The photoresist is exposed to an image of a circuit pattern, thereby changing the solubility of selected portions of the photoresist layer in accordance with the circuit pattern. Boards having an exposed photoresist layer are mounted on a conveyer and dipped or sprayed with solvent or developer. Typically, a spray booth is used having an array of spray nozzles fed by a pump connected to a sump in the bottom of the booth which collects the developer running off the boards.

The photochemical change in the photoresist is not absolute, i.e. the photoresist does not change from completely soluble to completely insoluble. Therefore, it is important to develop the photoresist only long enough to remove the photoresist from those areas where it is intended to be removed. In the remaining areas, the photoresist may become thinner but is not completely removed. The point of complete development is referred to as the breakpoint and should occur prior to the board exiting the spray zone in the booth, typically sixty percent through the zone. Under-developing can cause short circuits in finished printed circuit boards. Over-developing can cause changes in the geometry of the lines in the photoresist, e.g. a line will become narrower as well as thinner, possibly causing an open circuit. For these reasons, a correct breakpoint is critical for printed circuit boards having patterns of closely spaced, fine lines.

As used herein, "develop" refers to the process for forming a pattern in a layer irrespective of how the process is accomplished. That is, the pattern can be formed by dissolving portions of the layer or by etching, i.e. chemically reacting with portions of the layer to form soluble or volatile compounds.

The photoresist remaining on a board after development is used as a mask for the underlying conductive layer, transferring the circuit pattern from the photoresist to the conductive layer. After the conductive layer is patterned and the remaining photoresist is removed, a board is typically coated with a solder mask layer, giving the board the greenish appearance seen on the "foil" or circuit side of the board.

The breakpoint is determined by the reaction rate of the developer which, in turn, depends on a number of factors including the temperature and concentration of the developer. As can be imagined, using a developer until it is exhausted causes a continuously changing breakpoint and, consequently, can cause significant differences between supposedly identical printed circuit boards. In a typical batch replenishment operation, development time can increase by as much as fifty percent as the developer reaches exhaustion. Batch replenishment, in which the sump is completely drained and re-filled with fresh developer, causes significant down time and quality control problems and a suitable alternative has been sought for a long time.

Continuously replenishing a developer sump, in which a small fraction of the capacity of the sump is pumped into the sump for each board processed, requires a large reservoir for the replenishing solution and may not solve the problem. The consumption of developer depends upon the amount of photoresist being removed, which is determined by the circuit pattern and the size of each board. This is referred to as the "loading" on the developer. Since the loading varies unless an entire shift is devoted to producing the same circuit board, continuously replenishing the developer will not produce uniform results.

For environmental and safety reasons, an inorganic, water soluble developer is used, e.g. potassium carbonate, and the reaction with the photoresist produces a bicarbonate and dissolved photoresist resin. The concentrations of carbonate, bicarbonate, and resin determine the pH of the developer. It is known in the art to monitor pH as an indication of the condition of the developer since an increasing concentration of dissolved resin decreases the pH of the developer.

A problem with monitoring pH for automatic replenishment is that the pH electrode quickly becomes coated with scale from tap water and dissolved resin. A commercially available system avoids contamination of the pH electrode by periodically flushing the electrode with an acid solution. The same system avoids using a large reservoir for the replenishing solution by mixing developer as needed from concentrated developer. Mixing is controlled by a solenoid valve on a water line and by a metering pump for the concentrated developer. While this system is a significant improvement over previous systems, problems remain. The acid bath shortens the life of the pH electrode and the mixing of replenishment solution is not sufficiently accurate to maintain constant breakpoint. Water mains vary considerably in pressure and temperature and metering pumps must be calibrated frequently to maintain constant flow.

In view of the foregoing, it is therefore an object of the invention to provide an improved method and apparatus for automatically replenishing developer.

Another object of the invention is to provide a method and apparatus for maintaining constant breakpoint in developer.

A further object of the invention is to provide an improved method and apparatus for mixing solutions accurately.

Another object of the invention is to provide a more consistent reaction rate by matching the temperature of the replenishment solution to the temperature of the developer.

A further object of the invention is to provide a compact replenishment system that is accurate and does not require expensive, precise components.

SUMMARY OF THE INVENTION

The foregoing objects are achieved in the invention in which a replenishing solution is mixed from concentrate and tap water. Rather than measure the flow of liquids, the apparatus constructed in accordance with the invention measures static volumes of reagents, then transfers the reagents to a replenishing tank where they are mixed and brought to a predetermined temperature. Precise volumes are measured by weirs in each of the containers for water and concentrate. The replenishing solution is added to a working solution in amounts determined by the pH of the working solution. The electrode of a meter used for measuring pH are protected from scale or deposits by a sequestering agent, preferably EDTA, contained in the replenishing solution.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figures 1, 2:
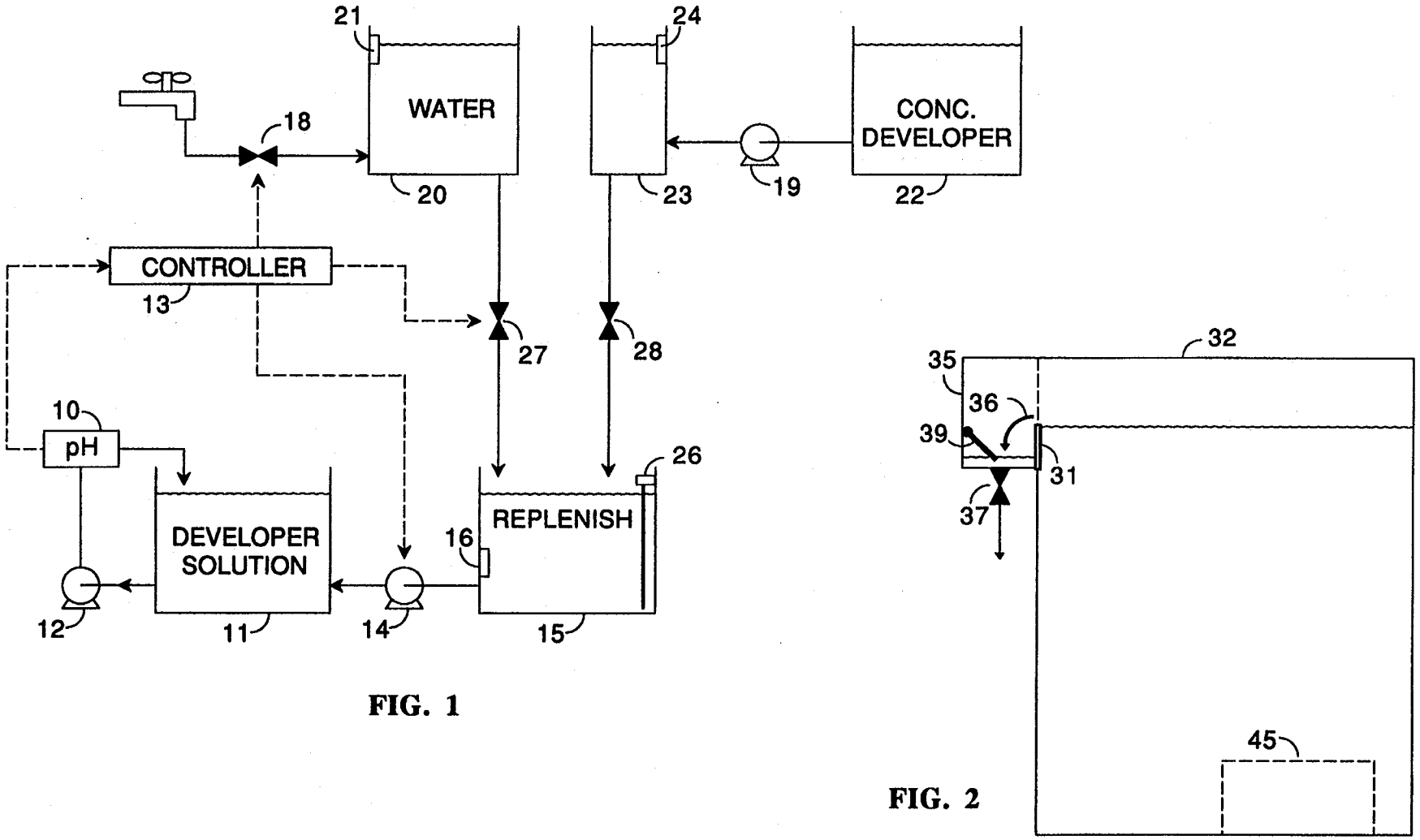
FIG. 1 schematically illustrates a replenishment system constructed in accordance with the invention.
FIG. 2 illustrates the apparatus for precisely determining the volume of reagents for the developer.

FIG. 1 illustrates a preferred embodiment of a replenishment system constructed in accordance with the invention. Meter 10 monitors the pH of the developer in sump 11 by means of recirculating pump 12. If the pH falls below a preset point, controller 13 turns on pump 14 to transfer replenishing solution from tank 15 to sump 11 until the pH rises above the set point, at which point controller 13 turns off pump 14. As described thus far, the system provides closed loop control of the pH of the developer as known in the art. Unlike the prior art, replenishing tank 15 is relatively small, approximately equal to the size of sump 11. In addition, the replenishing solution is made from concentrate by mixing the concentrate with tap water in precisely controlled amounts to provide a consistent concentration of replenishing solution.

When the level of the solution in replenishing tank 15 goes below a predetermined point, as detected by level sensor 16, controller 13 opens valve 18 and turns on pump 19. Valve 18 allows water from a pressurized water line to flow into tank 20 until it fills to a level above float switch 21. Pump 19 transfers concentrated developer from tank 22 into tank 23 until the level of concentrate in tank 23 reaches float switch 24.

The volumes of solvent and concentrate in tanks 20 and 23 are in proportion to the desired concentration for the replenishing solution in tank 15. The concentration of potassium carbonate in tank 22 is not critical and a concentration of 100–600 grams per liter has been found suitable, with 450 grams per liter preferred. The concentration of carbonate in replenishing tank 15 is typically 8–12 grams per liter. Thus, the volume of tank 20 is approximately forty-four times the volume of tank 23.

When float switches 21 and 24 have both been tripped, controller 13 opens valves 27 and 28, allowing tanks 20 and 23 to drain simultaneously into tank 15. The volumes of liquids in tanks 20 and 23 is known precisely and therefore the concentration of the mixture in replenishing tank 15 is consistent from batch to batch. To further improve consistency, tank 15 is provided with heater 26 for maintaining the temperature of the replenishing solution at the same temperature as the developer in tank 11. Thus, in accordance with one aspect of the invention, the breakpoint of the developer is maintained constant by providing a replenishing solution of consistent concentration and at the same temperature as the developer.

Meter 10, valves 18 and 27, and pump 14 are all connected to controller 13, as indicated by the dotted lines therebetween. In addition, float switches 21 and 24, level sensor 16, heater 26, valve 28, and pump 19 are also connected to controller 13. The temperature of the developer in replenishing tank 15 is monitored by a temperature sensor (not shown) also connected to controller 13.

Deposits of dissolved resin and scale from tap water can form on the electrode of meter 10. In order to reduce deposits, a sequestering agent is added to the concentrated developer in tank 22, preferably in a concentration of 1–100 grams per liter, with a concentration of 30 grams per liter being preferred. The preferred sequestering agent is tetra-sodium ethylene-diamine-tetra-acetic acid (EDTA). This compound prevents the accumulation of scale and photoresist residue on the electrode of meter 10, thereby increasing the accuracy of pH readings and increasing the life of the electrode.

In accordance with another aspect of the invention, the volume of water and the volume of concentrated developer are precisely determined by the apparatus illustrated in FIG. 2. By monitoring the static volume of the water and concentrated developer, one avoids the problem of fluctuating line pressure and the problem of frequently calibrating a metering pump.

In FIG. 2, tank 30 includes weir 31 slightly below top 32 of tank 30. As illustrated in FIG. 2, weir 31 is a reduced height portion of the sidewall of tank 30 in common with side tank 35. As tank 30 is filled with liquid, the level of the liquid will progress up the tank until it reaches the top of weir 31, at which point the liquid will begin flowing over the weir into side tank 35, as indicated by arrow 36. The top of weir 31 is located precisely above the floor of tank 30 for a predetermined amount of liquid to be contained in the tank. The volume of liquid contained within tank 30 is precisely known and any overfilling of tank 30 simply accumulates in side tank 35.

Float switch 39 detects the level of liquid in side tank 35. In a preferred embodiment of the invention, the supply of liquid to tank 30 is continued for a couple of seconds after float switch 39 indicates the presence of liquid in side tank 35, thereby assuring that tank 30 is filled to the proper level. Drain 37 is actuated at the same time that tank 30 is drained.

Float switch 39 does not precisely measure the level of liquid in side tank 35. The particular switch used is a matter of design and is not critical to the invention. In fact, the invention permits use of inexpensive components since neither the flow nor the volume of reagent is being measured by the switch.

In FIG. 1, tanks 20 and 23 are constructed in the same manner as tank 30 and contain precise amounts of water and concentrated developer, respectively. The concentration of the replenishing solution is precisely determined by the volumes of tanks 20 and 23, which are fixed. In order to vary the concentration of the replenishing solution, one simply adds blocks of known volume, such as block 45 in FIG. 2, to the appropriate tank thereby decreasing the capacity of the tank by a known, precise amount. In one embodiment of the invention, each block displaces a volume of fifty milliliters.

The invention thus provides an improved method and apparatus for automatically replenishing developer in a system for developing photoresist on printed circuit boards. A constant breakpoint is maintained by accurately measuring the pH of the developer and by accurately mixing replenishment solutions of developer. A constant breakpoint is further assured by controlling the temperature of the replenishing solution to match the temperature of the working solution, thereby maintaining a consistent reaction rate for the developer.

Having thus described the invention, it will be apparent to those of skill in the art that various modifications can be made within the scope of the invention. For example, while described in terms of an development system for photoresist, it is understood that the invention can be used in any process where precise mixing of reagents is desired for consistent results from replenishment solutions. Further, the invention is not limited to the particular chemicals involved. For example, water is the solvent for the particular application described but any suitable component can be used in a system for precisely mixing reagents. While weir 31 is described as a wall of reduced height, it is understood that side tank 35 can be a separate container attached to tank 30 by a hose connected to a hole in the side of tank 30. The height of the hole above the floor of tank 30 determines the volume contained in tank 30 prior to overflow through the hole. While providing a particularly compact replenishment system, it is understood that the system of the invention can be scaled to any size to suit a particular application. Other sequestering agents, such as pentasodium diethylenetriamine penta-acetic acid, can be used instead of EDTA. One can substitute valves for pumps, and vice-versa, depending upon the relative heights of the components. For example, tanks 20 and 23 rely on gravity to transfer their contents to tank 15. If tanks 20 and 23 are not higher than tank 15, then one must substitute pumps for valves 27 and 28. Conversely, one can substitute a valve for pump 14 if tank 15 is located higher than tank 11. Controller 13 can be any eight bit or sixteen bit microcontroller such as is available from Intel, Motorola, and other manufacturers.

I claim:

1. Apparatus for replenishing a volume of working solution having a predetermined concentration of developer, said apparatus comprising:

a first tank for containing replenishing solution, said first tank having a first capacity approximately equal to said volume of working solutions;

a second tank for receiving solvent and having a second capacity, wherein said second tank includes a first weir for determining said second capacity;

a third tank for receiving concentrated developer and having a third capacity, wherein said third tank includes second weir for determining said third capacity;

a first valve for coupling said first tank to said second tank;

a second valve for coupling said first tank to said third tank;

wherein said second capacity and said third capacity are in a ratio such that when the contents of said second tank and said third tank are transferred to said first tank, the concentration of said replenishing solution is the same as said predetermined concentration.

2. The apparatus as set forth in claim 1 wherein said second tank includes a first side tank for receiving overflow from said first weir and said third tank includes a second side tank for receiving overflow from said second weir.

3. The apparatus as set forth in claim 2, wherein said first side tank includes a first level sensing switch and said second side tank includes a second level sensing switch.

4. Apparatus for replenishing a volume of working solution having a predetermined concentration of developer, said apparatus comprising:

a first tank for containing replenishing solution, said first tank having a first capacity approximately equal to said volume of working solution;

a second tank for receiving solvent and having a second capacity;

a third tank for receiving concentrated developer and having a third capacity;

a first valve for coupling said first tank to said second tank;

a second valve for coupling said first tank to said third tank;

wherein said second capacity and said third capacity are in a ratio such that when the contents of said second tank and said third tank are transferred to said first tank, the concentration of said replenishing solution is the same as said predetermined concentration; and at least one block of predetermined volume for insertion into said second tank or said third tank for adjusting the concentration of said replenishing solution.

5. Apparatus for developing photoresist on printed circuit boards, said apparatus comprising:

a first tank for storing developer having a predetermined concentration;

a second tank for containing replenishing solution;

a pump coupling said second tank to said first tank;

a third tank for receiving solvent and having a first capacity;

a fourth tank for receiving concentrated developer and having a second capacity;

a first valve for coupling said second tank to said third tank;

a second valve for coupling said second tank to said fourth tank;

a pH meter for measuring the pH of said developer;

a controller electrically coupled to said pH meter and to said pump for transferring replenishing solution to said first tank when at a predetermined pH of said developer;

wherein said first capacity and said second capacity are in a ratio such that when the contents of said third tank and said fourth tank are transferred to said second tank, the concentration of said replenishing solution is the same as said predetermined concentration.

6. The apparatus as set forth in claim 5 and further comprising:

a level sensor in said second tank electrically connected to said controller for causing said controller to open said first valve and said second valve when the replenishing solution in said second tank reaches a predetermined level.

7. The apparatus as set forth in claim 6 wherein said third tank includes a first weir for determining said first capacity and said fourth tank includes a second weir for determining said second capacity.

8. The apparatus as set forth in claim 7 wherein said third tank includes a first side tank for receiving overflow from said first weir and said fourth tank includes a second side tank for receiving overflow from said second weir.

9. The apparatus as set forth in claim 8 wherein said first side tank includes a first level sensing switch and said second side tank includes a second level sensing switch, wherein said first level sensing switch and said second level sensing switch are electrically connected to said controller.

10. The apparatus as set forth in claim 9 and further comprising:

a fifth tank for containing concentrated developer;

a second pump connecting said fifth tank to said fourth tank for transferring concentrated developer from said fifth tank to said fourth tank.

11. A method for precisely mixing liquids in a predetermined concentration, said method comprising:

providing a first container with a first weir for fixing the capacity of said first container at a first predetermined level;

providing a second container with a second weir for fixing the capacity of said second container at a predetermined ratio to the capacity of said first container, wherein said ratio corresponds to said predetermined concentration;

filling said first container with a first liquid until said first liquid overflows said first weir;

filling said second container with a second liquid until said second liquid overflows said second weir; and draining said first container and said second container into a third container.

12. A method for developing photoresist on printed circuit boards, said method comprising the steps of:

(a) providing a first container with a first weir for fixing the capacity of said first container at a first predetermined level;

(b) providing a second container with a second weir for fixing the capacity of said second container at a predetermined ratio to the capacity of said first container;

(c) mixing a batch of replenishing solution by:

(i) filling said first container with a concentrated developer until said concentrated developer overflows said first weir, said concentrated developer including 1–100 grams per liter of a sequestering agent;

(ii) filling said second container with water until said water overflows said second weir;

(iii) draining said first container and said second container into a third container to fill said third container with replenishing solution;

(d) providing a sump for storing developer;

(e) maintaining the pH of the developer in said sump at a constant level by measuring the pH of the deveolper in said sump and adding replenishing solution from said third container to said sump; and (f) spraying the developer on said printed circuit boards.

13. The method as set forth in claim 12 and further comprising the step of:

maintaining the temperature of the replenishing solution at the temperature of the developer.

14. The method as set forth in claim 12 and further comprising the steps of;

monitoring the level of the replenishing solution in said third container; and mixing a new batch of replenishing solution when said level is at a predetermined point.

* * * * *